US005190588A

United States Patent [19]

Matushita et al.

[11] Patent Number: 5,190,588

[45] Date of Patent: Mar. 2, 1993

[54] ELECTROSTATIC COATING FACILITY FOR ELECTROCONDUCTIVE COATING MATERIAL

[75] Inventors: Masaharu Matushita, Nagoya; Tomoyasu Ito, Seto; Touichi Watanabe, Yokohama; Akira Shoji, Nagoya; Michitaka Moritani; Takatoshi Okuta, both of Toyota, all of Japan

[73] Assignee: Trinity Industrial Corporation, Tokyo, Japan

[21] Appl. No.: 752,051

[22] Filed: Aug. 29, 1991

[30] Foreign Application Priority Data

| | | | |
|---|---|---|---|
| Aug. 30, 1990 | [JP] | Japan | 2-226656 |
| Aug. 30, 1990 | [JP] | Japan | 2-226657 |
| Nov. 30, 1990 | [JP] | Japan | 2-330213 |
| Dec. 28, 1990 | [JP] | Japan | 2-408643 |

[51] Int. Cl.[5] ..... B05B 5/025

[52] U.S. Cl. ..... 118/635; 118/324

[58] Field of Search ..... 118/630, 635, 324; 198/465.1, 465.3

[56] References Cited

U.S. PATENT DOCUMENTS 4,014,428 3/1977 Ossbahr ..... 198/465.3

4,563,977 1/1986 Spengler ..... 118/635

FOREIGN PATENT DOCUMENTS 55-114366 9/1980 Japan .

56-141689 11/1981 Japan .

*Primary Examiner*—W. Gary Jones

*Assistant Examiner*—Charles K. Friedman

*Attorney, Agent, or Firm*—Cushman Darby & Cushman

[57] ABSTRACT

An electrostatic coating facility for an electroconductive coating material comprising a coating machine disposed in a coating zone while being grounded to the earth, an insulated conveyrer disposed in the coating zone for conveying an object to be coated in an electrically insulated state and applying a high voltage to the object, an entering conveyer disposed for carrying the object into the coating zone, a delivery conveyer for carrying the coated object out of the coating zone, and a relay transfer device interposed between the insulated conveyer 1 and the entering conveyer or the delivery conveyer for transferring the object in an electrically insulated state while keeping a required insulation distance between each of them. Aqueous coating material free from public pollution can be used with no troubles for taking insulative measures on the side of the coating machine and without worry of spark discharge.

7 Claims, 5 Drawing Sheets

ELECTROSTATIC COATING FACILITY FOR ELECTROCONDUCTIVE COATING MATERIAL

BACKGROUND OF THE INVENTION

1. Field of the Invention

The present invention concerns an electrostatic coating facility for electroconductive coating materials used for electrostatic coating of an aqueous coating material, a slurry coating material, metallic coating material or the like to objects to be coated which are conveyed continuously by way of a conveyer.

2. Description of the Prior Art

In a case of electrostatically coating an aqueous coating material by applying a high voltage to a coating machine while grounding an object to be coated to the earth, it is necessary to provide an insulative countermeasure to a system leading to the coating machine for supplying an aqueous coating material in order to prevent the high voltage applied to the coating machine from leaking (refer to Japanese Patent Laid Open Sho 55-114366 and 56-141869). However, in a multicolor coating apparatus adapted to conduct coating under color change of coating materials for as much as several tens of colors, there has been a trouble of insulating supply pipes, reservoirs, etc. on every colors of coating materials.

Therefore, in a multicolor coating for automobiles and like other objects, electrostatic coating by using insulative resin coating materials that consume a great amount of deleterious organic solvents have been predominantly and the use of aqueous coating materials, although free from such public pollutions, has been hesitated at present.

However, environmental protection actions have been raised world-wide in recent years and, also in the coating industry, regulation for the use of organic solvents such as hydrocarbons that cause environmental pollutions has been discussed and coating by means of aqueous coating materials not using thinner or the like has been recommended.

OBJECT OF THE INVENTION

It is, accordingly, an object of the present invention, for promoting the coating by using an aqueous coating material free from environmental pollution to avoid a trouble of taking an insulative countermeasure for a system of supplying a coating material to a coating machine while grounding a coating machine to the earth and applying a high voltage on the side of an object to be coated and, at the same time, to prevent the high voltage applied to the objects to be conveyed from leaking through a conveyer when such objects are conveyed continuously by way of the conveyer.

SUMMARY OF THE INVENTION

The foregoing object of the present invention can be attained by an electrostatic coating facility for applying an electroconductive coating material comprising a coating machine disposed in a coating zone while being grounded to the earth, an insulated conveyer disposed in the coating zone for conveying an object to be coated in an electrically insulated state and applying a high voltage to the object to be coated, an entering conveyer disposed for carrying the object to be coated into the coating zone, a delivery conveyer for carrying the object after coating out of the coating zone, and a relay transfer device interposed between the insulated conveyer and the entering conveyer, and between the insulated conveyer and the delivery conveyer for transferring the object in an electrically insulated state while keeping a required insulation distance between each of them, In accordance with the present invention, an object to be coated carried into by the entering conveyer is transferred by the relay transfer device interposed between the entering conveyer and the insulated conveyer in the electrically insulated state from the entering conveyer to the insulated conveyer disposed in the coating zone, while keeping a required insulation distance between both of the conveyers.

Then, the object to be coated transferred to the insulated conveyer is applied with a high voltage to form a static electric field between it and the coating machine disposed in the coating zone while being grounded to the earth and coating particles sprayed from the coating machine are attracted and adsorbed onto the object under the effect of the electric field.

The object after the electrostatic coating is transferred by the relay transfer device interposed between the insulated conveyer and the delivery conveyer in the electrically insulated state from the insulated conveyer to the delivery conveyer, while keeping the required insulation distance between both of the conveyers.

This enables to save troublesome insulative countermeasure to the system for supplying the coating material to the coating machine. At the same time, if objects to be coated are continuously conveyed by the respective conveyers, since the high voltage from the insulated conveyer that applies the high voltage to the objects to be coated does not leak to the entering conveyer or the delivery conveyer, electrostatic coating for the objects to be coated can be conducted at a good productivity.

BRIEF DESCRIPTION OF THE DRAWINGS

These and other objects, as well as advantageous features of the present invention will become apparent by reading the detailed descriptions for the preferred embodiments of the present invention with reference to the accompanying drawings, wherein.

DESCRIPTION OF THE PREFERRED EMBODIMENTS

The present invention will now be described more specifically by way of its preferred embodiments with reference to the accompanying drawings.

Figure 1:
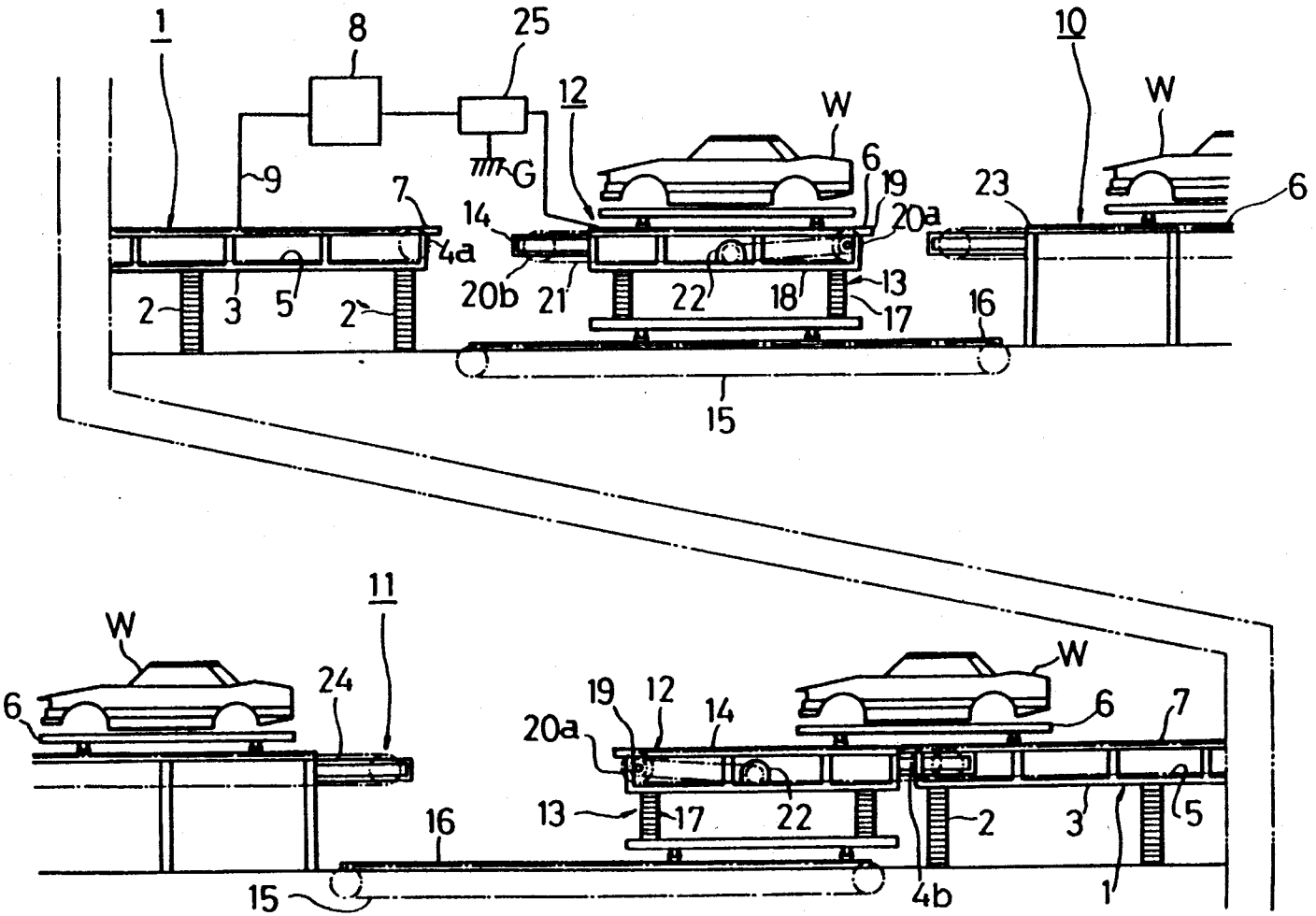
FIG. 1 is a front elevational view illustrating a first embodiment of an electrostatic coating facility according to the present invention.

At first, FIG. 1 is a front elevational view illustrating a first embodiment of an electrostatic coating facility according to the present invention.

In this embodiment, an insulated conveyer 1 is arranged along a coating zone in which a coating machine is disposed while being grounded to the earth. The insulated conveyer 1 serves to apply a high DC voltage of about 80 to 120 KV to a car body W as an object to be coated.

The insulated conveyer 1 comprises insulation supports 2 and 2 each standing vertically at a predetermined distance along the coating zone, a frame 3 supported horizontally between them, a pair of sprockets 4*a* and 4*b* disposed at both front and rear ends of the frame 3, and an endless chain 5 laid horizontally between both of the sprockets 4*a* and 4*b*, so that a conveyer truck 6 carrying the car body W thereon is trailed and caused to run along a conveyer rail 7 disposed along the upper end of the frame 3.

Further, a high voltage cable 9 from a high voltage generator 8 is connected to the conveyer rail 7 or the frame 3, so that a high voltage is applied from the conveyer rail 7 by way of the conveyer truck 6 to the car body W.

An entering conveyer 10 for carrying the car body W into the coating zone and a delivery conveyer 11 for carrying the car body W out of the coating zone are disposed, and a relay transfer device 12 is interposed between the conveyers 10 and 11 for transferring the car body W in an electrically insulated state while keeping a required insulation distance between it and each of conveyers.

The relay transfer device 12 comprises an insulated truck 13 that reciprocates between the insulated conveyer 1 and the entering conveyer 10 or the delivery conveyer 11, and a relay conveyer 14 mounted on the insulated truck 13 for transferring the car body W carried on the conveyer truck 6.

The insulated truck 13 is adapted to run reciprocally at a predetermined stroke on a conveyer rail 16 of a floor conveyer 15 laid between the insulated conveyer 1 and the entering conveyer 10 or the delivery conveyer 11. A relay conveyer 14 and its conveyer rail 19 are disposed on a frame 18 supported horizontally on each of a plurality of insulation supports 17, 17 - - - .

A pair of sprockets 20*a* and 20*b* are disposed at both front and rear ends of the frame 18 and an endless chain 21 is laid in parallel between them for trailing the conveyer truck 6. The chain 21 is driven intermittently in one direction by a motor 22 mounted on the frame 18, so that the conveyer truck 6 carrying the car body W is transferred from a conveyer rail 23 on the entering conveyer 10 by way of the conveyer rail 19 to the conveyer rail 7 on the insulated conveyer 1 or from the conveyer rail 7 on the insulated conveyer 1 by way of the conveyer rail 19 on the relay conveyer 14 to a conveyer rail 24 on the delivery conveyer 11.

A relay device 25 is disposed for switchingly connecting a high voltage cable 26 connected to the conveyer rail 19 or the frame 18 of each relay conveyer 14 between the high voltage generator 8 and the ground G.

In this embodiment, when the car body W carried on the conveyer truck 6 arrives at the terminal end of the conveyer rail 23 on the entering conveyer 10, the relay conveyer 14 of the relay transfer device 12 which has stood by on the side of the terminal end is actuated, by which the conveyer truck 6 on the conveyer rail 23 of the entering conveyer 10 is trailed by the chain 21 of the relay conveyer 14 and moved onto the conveyer rail 19.

Then, when the conveyer truck 6 is transferred to the conveyer rail 19, the relay conveyer 14 is stopped and, in turn, the floor conveyer 15 is actuated, and the insulated truck 13 of the relay transfer device 12 is caused to run from the entering conveyer 10 to the insulated conveyer 1 along the conveyer rail 16 on the floor conveyer 15.

Thus, the car body W mounted together with the conveyer truck 6 on the relay transfer device 12 is transferred electrically insulated state, to the insulated conveyer 1 applied with a high voltage, with a required insulation distance being kept between insulated conveyer 1 and the entering conveyer 10.

Then, when the relay conveyer 14 of the relay transfer device 12 and the entering conveyer 10 are spaced apart from each other by more than a predetermined insulation distance, the relay device 25 switchingly connects the high voltage cable 26 from the side of the ground G to the side of the high voltage generator 8 to apply a high voltage to the relay conveyer 14 and the car body W carried on the conveyer rail 19.

Then, when the insulated truck 13 of the relay transfer device 12 arrives at the beginning end of the insulated conveyer 1, the floor conveyer 15 is stopped and, in turn, the relay conveyer 14 mounted on the insulation truck 13 is actuated again, by which the conveyer truck 6 on the conveyer rail 19 of the conveyer 14 is trailed by the chain 21 and moved to the conveyer rail 7 of the insulated conveyer 1.

In this case, since the relay conveyer 14, as well as the conveyer truck 6 and the car body W on the conveyer rail 19 are previously applied with the high voltage and charged up to an identical potential level with that of the insulated conveyer 1, there is no risk of causing spark discharge between the insulated conveyer 1 and the relay conveyer 14 or the conveyer truck 6 and the car body W.

In this way, when the car body W carried on the conveyer truck 6 is transferred to the insulated conveyer 1, the relay conveyer 14 is stopped and, in turn, the floor conveyer 15 is actuated in the direction opposite to the above, by which the insulated truck 13 starts running from the insulated conveyer 1 to the entering conveyer 10 and, in the course of the running, the relay device 25 is actuated to switchingly connect the high voltage cable 26 connected to the relay conveyer 14 from the side of the high voltage generator 6 to the side of the ground, to thereby discharge residual electric charges on the relay conveyer 14.

Thus, the relay transfer device 12 returns to the terminal end of the conveyer rail 23 of the entering conveyer 10 without causing spark discharge between them and then stands by again on that side.

Meanwhile, the conveyer truck 6 transferred by the relay transfer device 12 to the insulated conveyer 1 is trailed by the chain 5 and caused to run on the conveyer rail 7 applied with the high voltage.

Thus, the car body W carried on the conveyer truck 6 is conveyed in an electrically insulated state along the coating zone in which the insulated conveyer 1 is disposed and, at the same time, applied with the high voltage from the conveyer rail 7 by way of the conveyer truck 6 to form a static electric field between it and the coating machine disposed in a state grounded to the earth in the coating zone.

Then, coating particles sprayed from the coating machine are attracted and adsorbed on the surface of the car body W under the effect of the electric field.

With such a constitution, there is no more trouble of applying an insulative countermeasure to the coating material supply system of the coating machine that sprays the electroconductive coating material such as an aqueous coating material, and the high voltage applied to the car body W to be electrostatically coated by the coating machine does not leak from the insulated conveyer 1 to the side of the entering conveyer 10.

Then, the car body W completed with the electrostatic coating is conveyed by way of the insulated conveyer 1 to the terminal end of the conveyer rail 7 and then transferred by the relay transfer device 12 that has stood by the side of the terminal end to the delivery conveyer 11 in an electrically insulated state, with a required insulation distance being kept between the insulated conveyer 1 and the delivery conveyer 11.

Thus, since the high voltage does not leak from the insulated conveyer 1 to the delivery conveyer 11, electrostatic coating can be applied while continuously conveying successive car bodies W.

Accordingly, the coating productivity for the car bodies W is not reduced.

Figure 2:
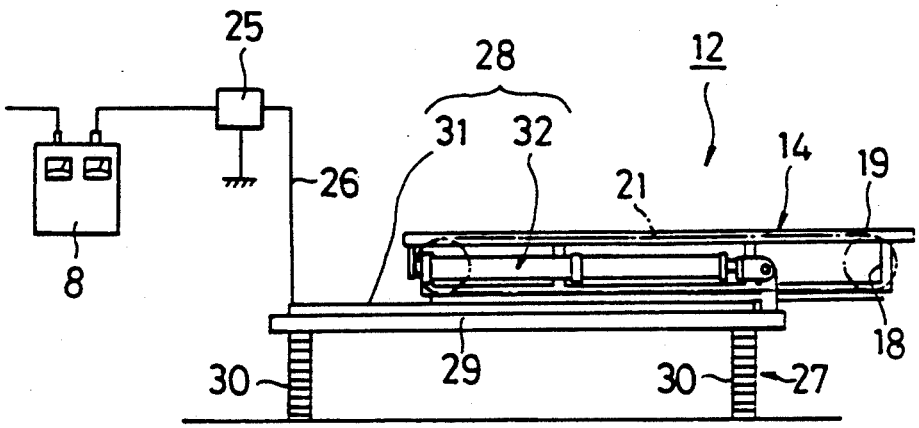
FIGS. 2(*a*), (*b*) and (*c*) are front elevational views illustrating a modified embodiment of a relay transfer device which constitutes a principal portion of the coating facility.
Figure 2:
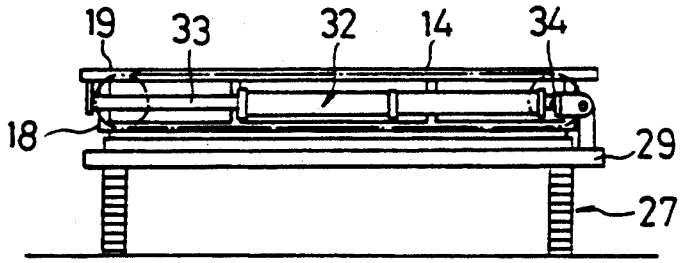
Figure 2:
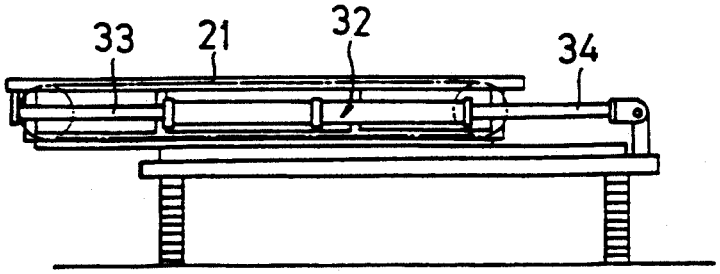

In this embodiment, the relay transfer device 12 illustrated in FIG. 1 is entirely reciprocated between the insulated conveyer 1 and the entering conveyer 10 or the delivery conveyer 11, but the present invention is not restricted only to such a constitution but, in a modified embodiment, only the relay conveyer 14 may be reciprocated as shown in FIG. 2(*a*), (*b*) and (*c*).

That is, FIG. 2(*a*), (*b*) and (*c*) show a front elevational view for the modified embodiment and the operation of the relay transfer device 12, in which an insulation stand 27 is secured at an intermediate position between the insulated conveyer 1 and the entering conveyer 10 or the delivery conveyer 11. A relay conveyer 14 and a sliding device 28 for reciprocally moving the relay conveyer 14 between the insulated conveyer 1 and the entering conveyer 10 or the delivery conveyer 11 are mounted on the insulation stand 27.

The insulation stand 27 comprises a table 29 carrying the relay conveyer 14 and the sliding device 28 thereon and a plurality of insulation supports 30, 30 - - - that support the table 29.

The sliding device 28 comprises a slide rail 31 laid on the table 29 and a double head cylinder 32 for reciprocally driving a frame 18 of the relay conveyer 14 slidably supported along a slide rail 31. The double head cylinder 32 has a piston rod 33 secured on the side of the frame 18 and another piston rod 34 secured on the side of the table 29.

In a case where the relay transfer device 12 having thus been constituted is disposed between the insulated conveyer 1 and the entering conveyer 10 shown in FIG. 1, when both of the piston rods 33 and 34 of the double head cylinder 32 are contracted as shown in FIG. 2(*a*), the relay conveyer 14 moves while sliding on the slide rail 31 to the side of the entering conveyer 10 and stands by on the side of the terminal end of the conveyer rail 23 of the conveyer 10.

When a conveyer truck 6 carrying a car body W arrives at the terminal end, the relay conveyer 14 trails by its chain 21 the conveyer truck 6 and transfers it from the conveyer rail 23 on the entering conveyer 10 to the conveyer rail 19 on the relay conveyer 14.

Then, only one piston rod 33 of the double head cylinder is extended to slidably move the relay conveyer 14 to such an intermediate position that a certain insulation distance can be kept between it and each of the entering conveyer 10 and the insulated conveyer 1 and, at that position, a high voltage cable 26 connected to a relay conveyer 14 is switchingly connected from the side of the ground to the side of the high voltage generator 8 to apply a high voltage to the relay conveyer 14.

Then, the other piston rod 34 is also extended to displace the relay conveyer 14 to the side of the insulated conveyer 1 as shown in FIG. 2(*c*).

Then, when the relay conveyer 14 arrives at the beginning end of the conveyer rail 7 of the insulated conveyer 1 shown in FIG. 1, the relay conveyer 14 again trails the conveyer truck 6 on the conveyer rail 16 by the chain 21 and transfers it to the conveyer rail 7 of the insulated conveyer 1.

In this way, since the car body W carried on the conveyer truck 6 is conveyed in an electrically insulated state and transferred from the entering conveyer 10 to the insulated conveyer 1 with a required insulation distance being kept between the insulated conveyer 1 and the entering conveyer 10, the high voltage applied to the insulated conveyer 1 does not leak to the entering conveyer 10.

In addition, since the high voltage is applied to the relay conveyer 14 that transfers the car body W while reciprocating between the entering conveyer 10 and the insulated conveyer 1, in the course of movement from the entering conveyer 10 to the insulated conveyer 1, there is no risk of causing spark discharge due to a potential difference formed between the relay conveyer 14 and the insulated conveyer 1.

In a case where the insulated conveyer 1 is such a short conveyer as conveying the car body W only one by one, occurrence of spark discharge can be prevented also by switchingly connecting the high voltage cable 9 connected to the insulated conveyer 1 between the high voltage generator 8 and the ground, so that the insulated conveyer 1 is grounded to the earth only when the car body W is transferred between the relay conveyer 14 and the insulated conveyer 1.

A second embodiment according to the present invention will now be described with reference to FIG. 3 through FIG. 7.

Figure 3:
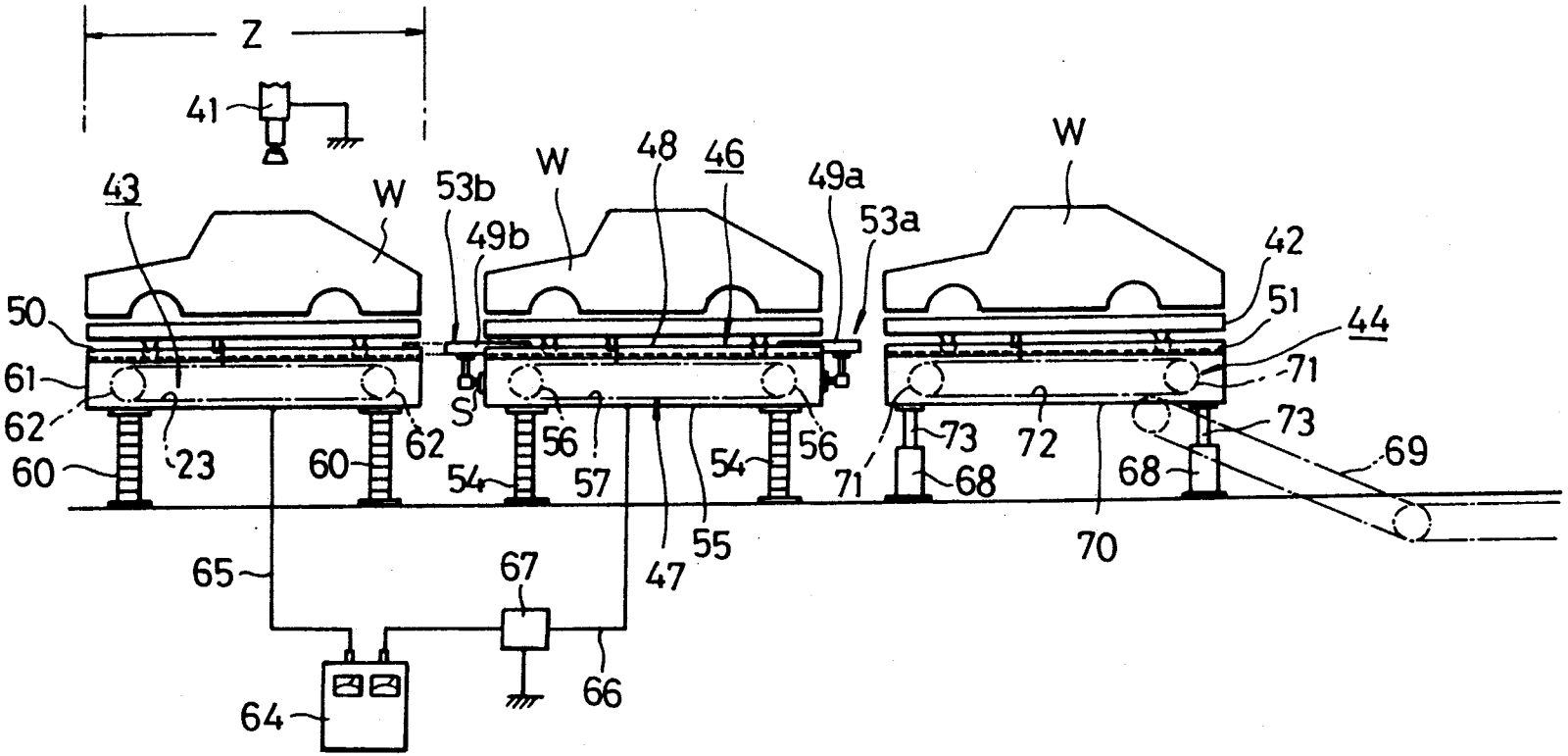
FIG. 3 is a front elevational view illustrating a second embodiment of an electrostatic coating facility according to the present invention.
Figure 4:
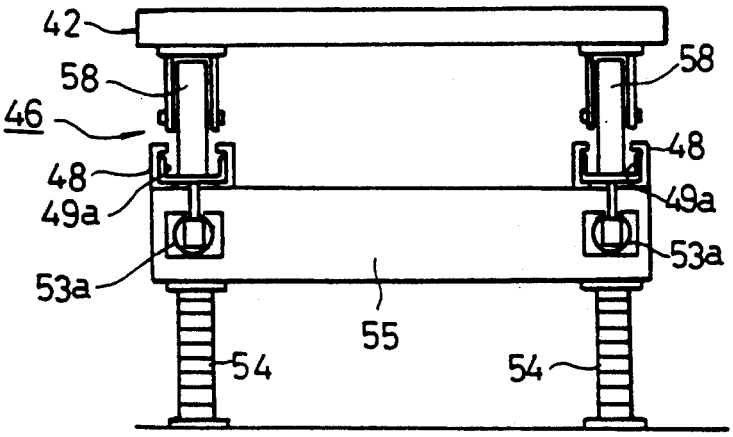
FIG. 4 is a side elevational view of a relay transfer device used in the facility.
Figure 5:
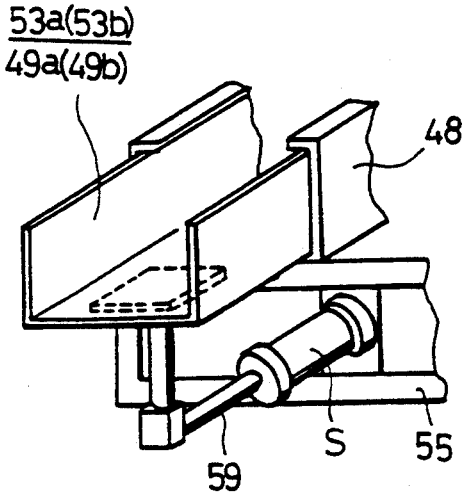
FIG. 5 is a perspective view illustrating a principal portion of the relay transfer device.
Figure 6:
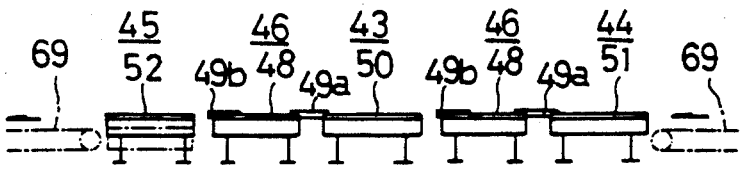
FIGS. 6(*a*), (*b*) and (*c*) are schematic views illustrating the operation of the relay transfer device.
Figure 6:
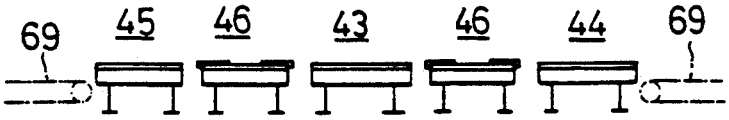
Figure 6:
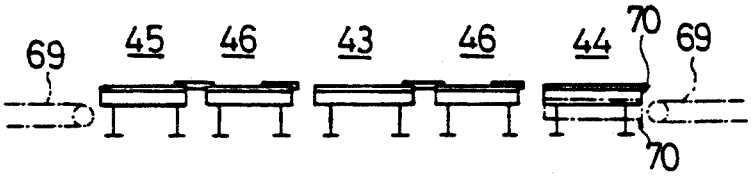
Figure 7:
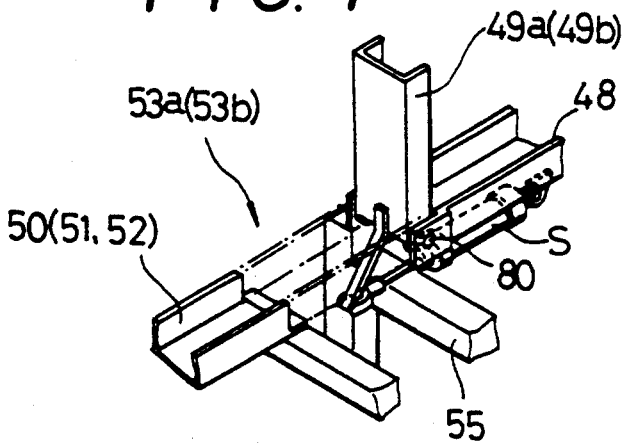
FIG. 7 is a perspective view for a principal portion illustrating a modified embodiment of the relay transfer device.

FIG. 3 is a front elevational view illustrating a second embodiment of an electrostatic coating facility according to the present invention, FIG. 4 is a side elevational view of a relay transfer device used for the facility, FIG. 5 is a perspective view illustrating a principal portion of the relay transfer device, FIGS. 6(*a*), (*b*), (*c*) are schematic views illustrating the operation of the relay transfer device and FIG. 7 is a perspective view for a principal portion of a modified embodiment of the relay transfer device.

In the coating facility of this embodiment, an insulated conveyer 43 is arranged in a coating zone Z, in which a coating machine 41 is disposed while being grounded to the earth. The insulated conveyer 43 is adapted to convey a car body W as an object to be coated carried on a conveyer truck 42 in an electrically insulated state and applying a high voltage to the car body W. A relay transfer device 46 is interposed between the insulated conveyer 43 and an entering conveyer 44 for carrying the car body W into the coating zone Z and between the insulated conveyer 43 and a delivery conveyer 45 for carrying the car body W out of the coating zone Z. The relay transfer device 46 is adapted to transfer the car body W in an electrically insulated state while keeping a required insulation distance between each of the conveyers.

Each of the relay transfer devices 46 comprises an insulated relay conveyer 47 disposed between the insulated conveyer 43 and the entering conveyer 44 or the delivery conveyer 45 at a predetermined insulation distance, right and left conveyer rails 48 and 48 of the insulated conveyer 47, relay rails 49*a* and 49*b* stacked slidably on both ends of the relay rails and bridging devices 53*a* and 53*b* for protruding and retracting each of the relay rails 49*a* and 49*b* relative to the right and left conveyer rails 50 of the insulated conveyer 43 and the right and left conveyer rails 51 of the entering conveyer 44 or the right and left conveyer rails 52 of the delivery conveyer 45 respectively.

The insulated relay conveyer 47 comprises a frame 55 supported by a plurality of insulation supports 54, 54, - - -a pair of sprockets 46 and 46 disposed on both ends of the frame 55 and an endless chain 57 laid in parallel between the sprockets for trailing the conveyer truck 42 carrying the car body W.

Each of the relay rails 49*a* and 49*b* disposed on both sides of the conveyer rail 48 is constituted with C-shaped steel material slidably inserted along the inside of the conveyer rail 48 on which wheels 58 of the conveyer truck 42 are caused to run.

Each of the bridging devices 53*a* and 53*b* comprises an air cylinder S fixed at its base to the frame 55 and at its rod head to each of the relay rails 49*a* and 49*b*, so that each of the relay rails 49*a* and 49*b* is protruded or retracted by the extension and contraction of the piston rod 59 of the cylinder S.

The insulated conveyer 43 comprises a frame 61 supported by a plurality of insulation supports 60, 60, - - -at the same height as the frame 55 of the insulated relay conveyer 47, a pair of sprockets 62 and 62 disposed on both ends of the frame 61 and an endless chain 63 disposed in parallel between both of the sprockets 62 and 62 for trailing the conveyer truck 42.

Then, a high voltage cable 65 is connected to the insulated conveyer 43 for applying a high DC voltage of about 80 to 120 KV from a high voltage generator 64.

A high voltage cable 66 connected to the insulated relay conveyer 47 is switchingly connected between the high voltage generator 66 and the ground by means of a relay device 67 interposed in the midway of the cable 66.

Each of the entering conveyer 44 and the delivery conveyer 45 comprises a frame 70 supported vertically movably on a plurality of cylinders 68, 68, - - - so as to be lifted from the height of a line conveyer 69 to the same height as that for the frame 55 of the insulated relay conveyer 47, a pair of sprockets 71 and 71 disposed on both ends of the frame 70 and an endless chain 72 laid in parallel between the sprockets 71 and 71 for trailing the conveyer 42.

In this embodiment, the entering conveyer 44 receives the conveyer truck 42 carrying a car body W from the line conveyer 69 laid along the coating line, in a state where the piston rods 73 for the respective cylinders 68, 68, - - -that support the lack 70 is contracted as shown by the dotted chain in FIG. 6(*c*). Then, the conveyer 49 transfers the conveyer truck 42 onto the conveyer rail 51 of the entering conveyer 44.

Then, the piston rods 73 for the respective cylinders 68, 68 - - - are extended at the same time to lift the frame 70, so that the conveyer rail 51 carrying the conveyer truck 42 is raised to the same height as the conveyer rail 48 of the insulated relay conveyer 47 constituting the relay transfer device 46.

In this state, the bridging device 53*a* of the relay transfer device 46 is actuated to project the relay rail 49*a* from one end of the conveyer rail 48 of the insulated relay conveyer 47 to the side of the conveyer rail 51 of the entering conveyer 44, to bridge the conveyer rails 48 and 51 by the relay rail 49*a*. At the same time, the entering conveyer 44 and the insulated relay conveyer 47 are actuated to transfer the conveyer truck 42 from the conveyer 51 of the entering conveyer 44 by way of the relay rail 49*a* to the conveyer rail 48 of the insulated relay conveyer 47.

Then, when the conveyer truck 42 is transferred to the conveyer rail 48 of the insulated relay conveyer 47, the relay rail 49*a* bridging the conveyer rail 51 of the entering conveyer 44 and the conveyer rail 48 is retracted to space apart the entering conveyer 44 and the insulated relay conveyer 47 by a predetermined insulation distance. Subsequently, the high voltage cable 66 connected to the insulated relay conveyer 47 is switchingly connected by the relay device 67 from the side of the ground to the side of the high voltage generator 66, to apply a high voltage to the insulated relay conveyer 47, as well as the conveyer truck 42 and the car body W now transferred on the conveyer rail 48.

Then, the bridging device 53*b* is actuated to project the rail 49*b* from the other end of the conveyer rail 48 of the insulated relay conveyer 47 to the side of the conveyer rail 50 of the insulated conveyer 43 disposed in the coating zone Z, to bridge the conveyer rails 48, 50 by the relay rail 49*a*.

In this case, since the insulated relay conveyer 47 and the conveyer truck 42 and the car body W carried on the conveyer rail 48 are previously applied with the high voltage and charged to an identical potential level with that of the insulated conveyer 43, there is no risk of causing spark discharge between the insulated relay conveyer 47 and the insulated conveyer 43.

Then, the insulated relay conveyer 47 and the insulated conveyer 43 are actuated to transfer the conveyer truck 42 from the conveyer rail 48 of the insulated relay conveyer 47 by way of the relay rail 49*b* to the conveyer rail 50 of the insulated conveyer 43.

In this way, when the conveyer truck 42 carrying the car body W is transferred to the insulated conveyer 43, the relay rail 49*b* is retracted to space apart the insulated conveyer 43 and the insulated relay conveyer 47 by a predetermined insulation distance. Subsequently, the high voltage cable 66 connected to the insulated relay conveyer 47 is switchingly connected from the side of the high voltage generator 64 to the side of the ground by the relay device 67 to discharge the residual charges on the insulated relay conveyer 47.

Thus, there is no more a risk of causing spark discharges when the insulated relay conveyer 47 receives the subsequent conveyer truck 42 from the entering conveyer 44.

Meanwhile, the car body W transferred together with the conveyer truck 42 to the insulated conveyer 43 and applied with the high voltage forms an electrostatic field between it and a coating machine 44 disposed in the state being grounded to the earth in the coating zone Z to attract and absorb coating particles sprayed from the coating machine 41 under the effect of the electric field.

With such a constitution, there is no more required to apply extremely expensive and troublesome insulative countermeasures to the coating material supply system of the coating machine 41 that sprays an electroconductive coating material such as an aqueous coating material.

Further, since the high voltage applied to the car body W to be electrostatically coated by the coating machine 41 does not leak from the insulated conveyer 43 to the entering conveyer 44 or the line conveyer 69, electrostatic coating can be applied while continuously conveying objects to be coated one by one by each of the conveyers.

Then, when electrostatic coating to the car body W has been completed, the conveyer truck 42 carrying the car body W is transferred by way of the insulated relay conveyer 47 of the relay transfer device 46 to the delivery conveyer 45.

The operation of the relay transfer device 46 in this embodiment is just opposite, in the sequence, to the operation of the relay transfer device 46 interposed between the insulation conveyer 43 and the entering conveyer 44 described previously and, accordingly, detailed descriptions will be omitted.

In this embodiment, the entering conveyer 44 and the delivery conveyer 45 are disposed independently of the line conveyer 69. However, the line conveyer 69 modified such that it is extended to the same height as that for the insulated relay conveyer 47 for each of the relay transfer devices 46 and may be used also as an entering conveyer or a delivery conveyer. The present invention also includes such a modified embodiment.

Further, the relay rails 49*a* and 49*b* disposed on the conveyer rail 48 of the insulated relay conveyer 47 are stacked slidably on both ends of the conveyer rail 48 and protruded and retracted horizontally in this illustrated embodiment. However, the invention is not restricted only to such an embodiment, but the relay rails 49*a* (49*b*) may be connected to both ends of the conveyer rail 48 each by means of a hinge 80 and protruded and retracted vertically by the rotation for a predetermined angle by a cylinder S of the bridging devices 53*a* (53*b*) as shown in FIG. 7.

Further, the insulated relay conveyer 47 is switchingly connected between the high voltage generator 64 and the ground so that spark discharge is not caused between the insulated relay conveyer 47 and the insulated conveyer 43 or the entering conveyer 44 in this second embodiment as described above. However, the invention is not restricted only to such an embodiment but the insulation conveyer 43 may be switchingly connected between the high voltage generator 64 and the ground upon transferring the conveyer truck 42 between the insulated relay conveyer 47 and the insulated conveyer 43.

Description will now be made to a third embodiment according to the present invention specifically with reference to FIG. 8.

Figure 8:
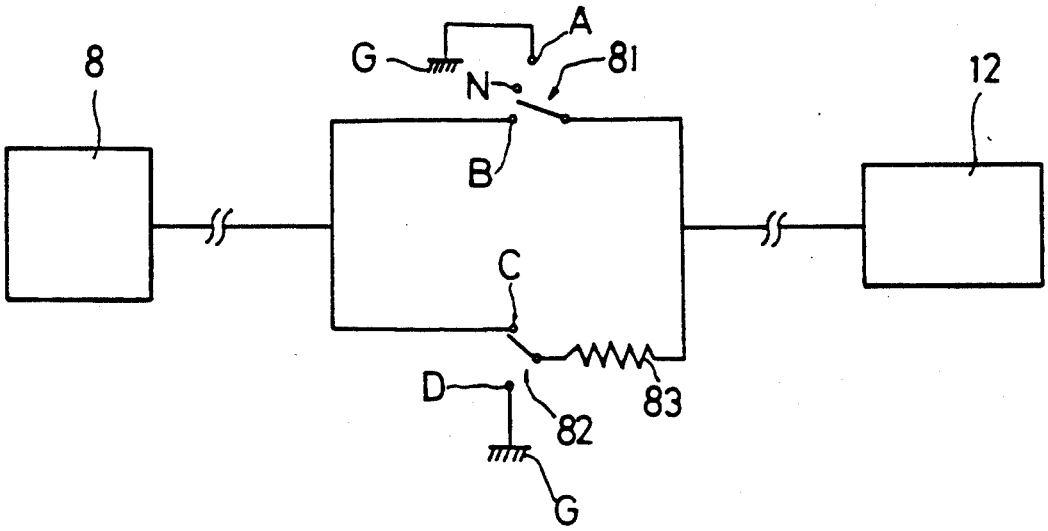
FIG. 8 is a circuit diagram for a relay device which constitutes a principal portion of a third embodiment of an electrostatic coating facility according to the present invention.

FIG. 8 is a circuit diagram for a relay device which is a principal portion of the third embodiment of an electrostatic coating facility according to the present invention.

The entire constitution of this embodiment is substantially identical with that of the first embodiment shown in FIG. 1 and detailed explanations therefor will be omitted.

A relay device 25 in this embodiment is adapted to switchingly connect a high voltage cable 26 connected to the conveyer rail 19 or the frame 18 in each of the relay conveyers 14 between the high voltage generator 8 and the ground. As shown in FIG. 8, a main switch 81 and an auxiliary switch 82 are disposed in parallel with each other, in which the contact B of the main switch 81 is connected with the high voltage generator 8, while the contact A is grounded to the earth. A neutral contact N is disposed between the contact A and the contact B.

The auxiliary switch 82 is adapted to select a contact C and a contact D by way of a resistor 83 having a high resistance value set to about 1500 to 7000M ohm, the contact C being connected with the high voltage generator 8, while the contact D being connected with the ground G.

Selective connection to each of the contacts is conducted, for example, by the operation of an insulated cylinder device or the like and the contacts are kept in an insulated state in the relay device 25 by an insulative oil or insulative gas filled therein.

Description will now be made to the operation of this embodiment.

When a car body W carried on the conveyer truck 6 arrives at the terminal end of the conveyer rail 23 of the entering conveyer 10, the relay conveyer 14 of the relay transfer device 12 that has stood by on the side of the terminal end is actuated, and the conveyer truck 6 on the conveyer rail 23 of the entering conveyer 10 is trailed by the chain 21 of the relay conveyer 14 and moved to the conveyer rail 19.

Then, when the conveyer truck 6 transfers to the conveyer rail 19, the relay conveyer 14 is stopped and, in turn, the floor conveyer 15 is actuated, by which the insulated truck 13 of the relay transfer device 12 is caused to run from the side of the entering conveyer 10 to the side of the insulated conveyer 1 along the conveyer rail 16 of the floor conveyer 15.

Thus, the car body W carried together with the conveyor truck 6 in the relay transfer device 12 is conveyed in an electrically insulated state to the insulated conveyer 1 applied with a high voltage, with a required insulation distance being kept between the insulated conveyer 1 and the entering conveyer 10.

Then, when the relay conveyer 14 of the relay transfer device 12 and the entering conveyer 10 are spaced apart by more than a predetermined insulation distance, the high voltage cable 26 of the relay device 25 is switchingly connected from the side of the ground G to the side of the high voltage generator 8, by which a high voltage is applied to the relay conveyer 14 and the car body W carried on the conveyer rail 19.

In the case of switchingly connecting the relay device 25 from the side of the ground G to the side of the high voltage generator 8, the auxiliary switch 82 is at first switched from the contact D to the contact C and then the main switch 81 is connected to the contact B on the side of the high voltage generator 8. Then, since the voltage is gradually increased through the resistor 83 of high resistance value and the potential difference between each of the contacts is kept low by the voltage drop, spark discharge is not caused between each of the contacts upon switching each of the switches 81 and 82 and damages for each of the contacts or degradation of insulation oil or the like can be prevented.

Successively, when the insulated truck 13 of the relay transfer device 12 arrives at the beginning end of the insulated conveyer 1, the floor conveyer 15 is stopped and, in turn, the relay conveyer 14 mounted on the insulation truck 13 is actuated again, by which the conveyer truck 6 on the conveyer rail 19 of the conveyer 14 is trailed by the chain 21 and transferred to the conveyer rail 7 of the insulated conveyer 1.

In this case, since the relay conveyer 14 and the conveyer truck 6 and the car body W on the conveyer rail 19 were previously applied with the high voltage and charged to the identical level with that of the insulated conveyer 1, there is no risk of causing spark discharge between the insulated conveyer 1 and the relay conveyer 14 or the conveyer truck 6 and the car body W.

In this way, when the car body W carried on the conveyer truck 6 is transferred to the insulated conveyer 1, the relay conveyer 14 is stopped and, in turn, the floor conveyer 15 is actuated in the direction opposite to the above, by which the insulated truck 13 starts running from the side of the insulated conveyer 1 to the side of the entering conveyer 10 and, in the course of the running, the relay device 25 is actuated to switchingly connect the high voltage cable 26 connected to the relay conveyer 14 from the side of the high voltage generator 8 to the side of the ground G, to discharge residual electric charges on the relay conveyer 14.

In this case, when the main switch 81 of the relay device 25 is once opened and situated on the neutral contact N, then the auxiliary switch 82 is switched from the contact C to the contact D on the side of the ground G and, subsequently, the main switch 81 is connected from the contact N to the contact A on the side of the ground G, electric charges on the relay transfer device 8 are gradually discharged through the resistor 83 a high resistance value and the potential difference between each of the contacts is kept low due to the voltage drop. Accordingly, the spark discharge is not caused and damages in each of the contacts and degradation of the insulation oil or the like can be suppressed.

Then, the relay transfer device 12 returns to the terminal end of the conveyer rail 23, without causing spark discharge between it and the entering conveyer 10, and stands-by again at that side.

Meanwhile, the conveyer truck 6 transferred by the relay transfer device 12 to the insulated conveyer 1 is trailed by the chain 5 and caused to run on the conveyer rail 7 applied with the high voltage.

Thus, the car body W scarried on the conveyer truck 6 is conveyed in an electrically insulated state along the coating zone in which the insulated conveyer 1 is disposed and, at the same time, applied with the high voltage by way of the conveyer truck 6 from the conveyer rail 7 and forms an electrostatic field between it and the coating machine disposed in the coating zone in a state grounded to the earth.

Then, coating particles sprayed from the coating machine are attracted and adsorbed on the surface of the car body W.

With such a constitution, there is no troubles of taking insulative countermeasures to the coating material supply system of the coating machine that sprays an electroconductive coating material such as an aqueous coating material and the high voltage applied to the car body W to be electrostatically coated by the coating machine does not leak from the insulated conveyer 1 to the side of the entering conveyer 10.

Subsequently, the car body W, after the completion of the electrostatic coating, is conveyed by the insulated conveyer 1 to the terminal end of the conveyer rail 7 and then transferred in an electrically insulated state to the delivery conveyer 11 by the relay transfer device 12 that has stood by on the side of the terminal end with keeping a predetermined insulation distance being kept between the insulated conveyer 1 and the delivery conveyer 11.

With this constitution, since the high voltage does not leak from the insulated conveyer 1 to the delivery conveyer 11, electrostatic coating can be conducted while continuously conveying respective car bodies W. Accordingly, the coating productivity for the car body W is not lowered.

In this embodiment, the relay transfer device 12 is adapted to move reciprocally for its whole portion between the insulated conveyer 1 and the entering conveyer 10 or the delivery conveyer 11. However, the present invention is not necessarily restricted only to such an embodiment but it may be modified such that only the relay conveyer 14 is reciprocated by means of a sliding device or the like.

Further, although the main switch 81 in the relay device 25 is constituted by a single switch in this embodiment, the present invention is not restricted only to such an embodiment but it may be modified such that individual switches are used for the connection on the side of the high generator 8 and for the connection on the side of the ground G separately.

Description will now be made to a fourth embodiment of an electrostatic coating facility according to the present invention with reference to FIG. 9.

Figure 9:
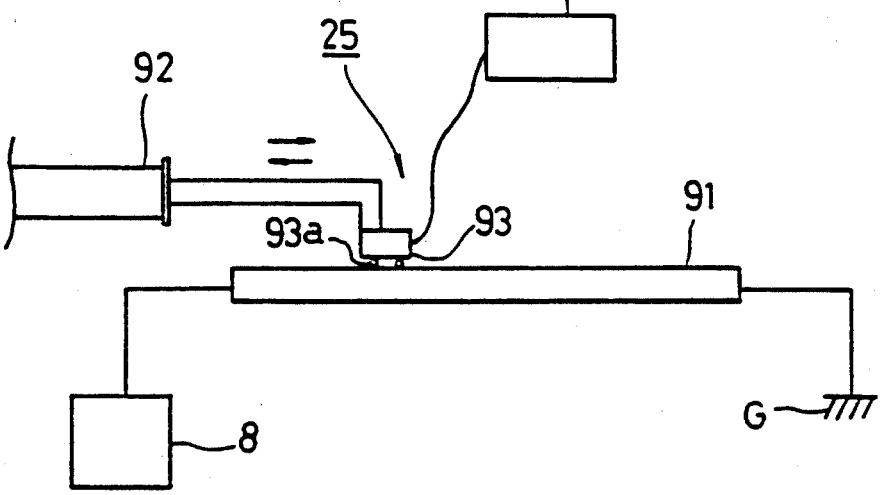
FIG. 9 is a schematic view illustrating a voltage controller which constitutes a principal portion of a fourth embodiment of an electrostatic coating facility according to the present invention.

FIG. 9 is a schematic view illustrating a voltage controller which is a principal portion of an electrostatic coating facility of the present invention.

The entire constitution of this embodiment is substantially the same as that for the first embodiment described above with reference to FIG. 1, and duplicate explanations therefor will be omitted.

In this embodiment, a voltage controller 25 is connected between a high voltage generator 8 and the ground G for properly increasing and lowering a voltage applied to each relay transfer device 14. As shown in FIG. 9, a linear resistor 91 having a high resistance value set to about 1000 to 7000M ohm is disposed within an insulation box filled with an insulation oil, an insulation gas or the like (not illustrated), and a movable contact 93 driven rightward and leftward by an insulated cylinder mechanism 92 is brought into sliding contact with the surface of the resistor 91.

Electroconductive roller **93*a* is disposed to the surface of the sliding contact 93 in contact with the resistor 91 for smoothing the movement of the movable contact in the rightward and leftward, to prevent the abrasion of the resistor 91**.

The resistor 91 is connected at its left end by way of a high voltage cable to a high voltage generator 8, while at its right end to the ground G in the same manner.

The movable contact 93 is connected by way of a high voltage cable to the relay transfer device 12.

Description will be made to the operation of this embodiment with reference to FIG. 1 in conjunction with FIG. 1.

When a car body W carried on the conveyer truck 6 reaches the terminal end of the conveyer rail 23 of the entering conveyer 10, the relay conveyer 14 of the relay transfer device 12 that has stood by on the side of the terminal end is actuated, by which the conveyer truck 6 on the conveyer rail 23 of the entering conveyer 10 is trailed by the chain 21 of the relay conveyer 14 and moves to the conveyer rail 19.

Then, when the conveyer truck 6 transfers to the conveyer rail 19, the relay conveyer 14 is stopped and, in turn, the floor conveyer 15 is actuated, by which the insulated truck 13 of the relay transfer device 12 is caused to run along the conveyer rail 16 of the floor conveyer 15 from the side of the entering conveyer 10 to the side of the insulated conveyer 1.

Thus, the car body W carried together with the conveyer truck 6 on the relay transfer device 12 is transferred in an electrically insulated state toward the insulated conveyer 1 applied with a high voltage with a predetermined insulation distance being kept between the insulated conveyer 1 and the entering conveyer 10.

Then, when the relay conveyer 14 of the relay transfer device 12 and the entering conveyer 10 are spaced apart by more than a predetermined insulation distance, the cylinder mechanism 92 of the voltage controller 25 is actuated to displace the moving contact 93 from the right end of the resistor 91, that is, from the side of the ground G to the left end of the resistor 91, that is, to the side of the high voltage generator 8, by which the voltage applied to the relay transfer device 12 is gradually raised into an identical potential to that of the insulated conveyer 1.

In this instance, since the movable contact 93 of the voltage controller 25 is moved relatively slowly by the cylinder mechanism 92 and the movement is conducted smoothly due to the conductive roller 93*a* disposed to the surface of the movable contact 93 in contact with the resistor 91, no spark discharge is caused between the movable contact 93 and the resistor 91, so that degradation or abrasion of the resistor 91 or the movable contact 98 can be prevented.

Furthermore, since the resistor 91 and the movable contact 93 are placed in the insulation box filled with the insulation oil or the insulation gas, creeping leakage is not caused.

Then, when the insulated truck 13 of the relay transfer device 12 arrives at the beginning end of the insulated conveyer 1, the floor conveyer 15 is stopped and, in turn, the relay conveyer 14 mounted on the insulated truck 13 is actuated again, by which the conveyer truck 6 on the conveyer rail 19 of the conveyer 14 is trailed by the chain 21 and moves to the conveyer rail 7 of the insulated conveyer 1.

In this instance, since the relay conveyer 14, as well as the conveyer truck 6 and the car body W on the conveyer rail 19 are previously applied with the high voltage by the voltage controller 25 and charged to an identical potential with that of the insulated conveyer 1, there is no risk of causing spark discharge between the insulated conveyer 1 and the relay conveyer 14 or the conveyer truck 6 and the car body W.

In this way, when the car body W carried on the conveyer truck 6 is transferred to the insulated conveyer 1, the relay conveyer 14 is stopped and, in turn, the floor conveyer 16 is actuated in the direction opposite to the above, by which the insulated truck 13 starts running from the side of the insulated conveyer 1 toward the entering conveyer 10 and, in the course of the running, the voltage controller 25 is operated to gradually release the residual charges on the relay transfer device 12 to lower the potential to that of the ground potential.

In this case, since the voltage controller 25 gradually lowers the voltage, no spark discharge is caused between the resistor 91 and the movable contact 93.

Then, the relay transfer device 12 returns without causing spark discharge between it and the entering conveyer 10 to the terminal end of the conveyer rail 23 and again stands by on that side.

Meanwhile, the conveyer truck 6 transferred by the relay transfer device 12 to the insulated conveyer 1 is trailed by the chain 5 and caused to run on the conveyer rail 7 applied with the high voltage.

With such a constitution, the car body W carried on the conveyer truck 6 is conveyed in an electrically insulated state along the coating zone in which the insulated conveyer 1 is disposed and, at the same time, applied with the high voltage from the conveyer rail 7 by way of the conveyer truck 6 and forms a static electric field between it and the coating machine disposed to the coating zone being grounded to the earth.

Then, coating particles sprayed from the coating machine are attracted and adsorbed on the surface of the car body W under the effect of the electric field.

In this way, there is no trouble of taking insulated countermeasures to the coating material supply system of the coating machine that sprays an electroconductive coating material such as an aqueous coating material and, in addition, the high voltage applied to the car body W to be electrostatically coated by the coating machine does not leak from the insulated conveyer 1 to the side of the entering conveyer 10.

Subsequently, the car body W completed with the electrostatic coating is conveyed by the insulated conveyer 1 to the terminal end of the conveyer rail 7 and transferred in an electrically insulated state by the relay transfer device 12 that has stood by on the side of the terminal end and then transferred to the delivery conveyer 11 with a predetermined insulation distance being kept between the insulation conveyer 1 and the delivery conveyer 11.

Thus, since the high voltage does not leak from the insulated conveyer 1 to the delivery conveyer 11, electrostatic coating can be applied while continuously conveying the respective car bodies W. Therefore, the coating productivity of the car bodies W is not lowered.

In this embodiment, the relay transfer device 12 is adapted to be reciprocated as a whole portion between the insulated conveyer 1 and the entering conveyer 10 or the delivery conveyer 11. However, the present invention is not necessarily restricted only to such an embodiment but it may be modified such that only the relay conveyer 14 is reciprocated by means of a sliding device or the like.

Further, the voltage controller 25 is not necessarily restricted to the slidable type as shown in this embodiment but, for example, a rotary type adapted to rotate the contact along with an arcuate resistor may also be used.

As has been described above, according to the present invention, since electrostatic coating is applied in a state of grounding a coating machine to the earth while applying a high voltage to an object to be coated, it can provide an excellent effect of no more requiring insulative countermeasures to the coating material supply system of the coating machine that sprays an electroconductive coating material such as an aqueous coating material which are troublesome and require expensive installation cost as well.

In addition, since objects to be coated can be transferred successively between the insulated conveyer for applying a high voltage to the objects in the coating zone and the entering conveyer for carrying the objects into the coating zone or the delivery conveyer for taking the objects out of the coating zone, without causing electric leakage due to high voltage from the insulated conveyer to the entering conveyer or the delivery conveyer, it can also provide an excellent effect that the coating productivity for the objects to be coated is excellent.

Accordingly, the present invention can promote the substitution of the insulative resin coating materials with the aqueous coating materials free from public pollution in the electrostatic coating and it has extremely high usefulness.

What is claimed is:

1. An electrostatic coating facility for applying an electroconductive coating material comprising, a coating machine disposed in a coating zone while being grounded to the earth, an insulated conveyer 1 disposed in said coating zone for conveying an object (W) to be coated in an electrically insulated state and applying a high voltage to the object (W) to be coated, an entering conveyer 10 disposed for carrying the object (W) to be coated into said coating zone, a delivery conveyer 11 for carrying the coated object (W) after coating out of said coating zone, and a relay transfer device 12 interposed between said insulated conveyer 1 and said entering conveyor 10, and between said insulated conveyer 1 and said delivery conveyer 11 for transferring the object (W) in an electrically insulated state while keeping a required insulation distance between each of them.

2. An electrostatic coating facility as defined in claim 1, wherein the relay transfer device 12 comprises an insulated truck 13 running reciprocally between the insulated conveyer 1 and the entering conveyer 10 or between the insulated conveyer 1 and the delivery conveyer 11, and a relay conveyer 14 mounted on said insulated track 13 for transferring the object (W) to be coated.

3. An electrostatic coating facility as defined in claim 1, wherein the relay transfer device 12 comprises an insulation stand 13 secured at a position between the insulated conveyer 1 and the entering conveyer 10 or between the insulated conveyer 1 and the delivery conveyer 11, and a relay conveyer 14 for transferring the object (W) to be coated and a sliding device 28 for reciprocally moving said relay conveyer 14 between the insulated conveyer 1 and the entering conveyer 10 or between the insulated conveyer 1 and the delivery conveyer 11 mounted on said insulation stand 13.

4. An electrostatic coating facility for applying an electroconductive coating material comprising, a coating machine 41 disposed in a coating zone (Z) while being grounded to the earth, an insulated conveyer 43 disposed in said coating zone (Z) for conveying the object (W) to be coated in an electrically insulated state and applying a high voltage to said object (W), an entering conveyer 44 for carrying the object (W) into the coating zone (Z), a delivery conveyer 45 for carrying the object (W) out of said coating zone (Z) and a relay transfer device 46 interposed between said insulated conveyer 43 and said entering conveyer 44 or between said insulated conveyer 43 and said delivery conveyer 45 for transferring the object (W) in an electrically insulated state between said insulated conveyer 43 and said entering conveyer 44 or between said insulated conveyer 43 and said delivery conveyer 45 while keeping a required insulation distance between each of them, in which said relay transfer device 46 comprises an insulated relay conveyer 47 disposed at a predetermined insulation distance relative to said insulated conveyer 43, a conveyer rail 48 of said insulated conveyer 47, relay rails 49*a* and 49*b* disposed on both ends of said conveyer rail 48 and bridging devices 53*a* and 53*b* for advancing and retracting said relay rails 49*a* and 49*b* relative to a conveyer rail 50 of the insulated conveyer 43 disposed in the coating zone (Z), and to conveyer rail 51 or 52 of the entering conveyer 44 or the delivery conveyer 45, respectively.

5. An electrostatic coating facility for applying an electroconductive coating material comprising a coating machine disposed in a coating zone while being grounded to the earth (G), an insulated conveyer 1 disposed in the coating zone for conveying an object (W) to be coated in an electrically insulated state and applying a high voltage to the object (W), an entering conveyer for carrying the object (W) to said coating zone, a delivery conveyer 11 for carrying the object (W) out of said coating zone, a relay transfer device 12 interposed between said insulated conveyer 1 and said entering conveyer 10 or between said insulated conveyer 1 and said delivery conveyer 11 for transferring the object (W) in an electrically insulated state between each of them while keeping a required insulation distance between each of them, a relay device 25 disposed for applying a high voltage to said relay transfer device 12 forwarding to the side of said insulated conveyer 1 and connecting the relay transfer device 12 forwarding to side of said entering conveyer 10 or to the side of the delivery conveyer 11 to the ground (G), a high voltage generator 8 and a circuit for connecting said high voltage generator 8 with said relay transfer device 12, in which said circuit comprises a main switch 81 and an auxiliary switch 82 disposed in parallel, said main switch 81 comprising a neutral position N is adapted to be switched between the contact (B) on the side of said high voltage generator 8 and the contact (B) on the side of the ground (G) and said auxiliary switch 82 is adapted to be switched between the contact (C) on the side of said high voltage generator 8 and the contact (D) on the side of the ground (G) by way of a resistor 83 having a high resistance value.

6. An electrostatic coating facility for applying an electronductive coating material comprising, a coating machine disposed in a coating zone while being grounded to the earth (G), an insulated conveyer 1 disposed in said coating zone for carrying an object (W) to be coated in an electrically insulated state and applying a high voltage to the object (W), an entering conveyer 10 for carrying the object W into said coating zone, a delivery conveyer 11 for carrying the object (W) out of said coating zone, a relay transfer device 12 interposed between said insulated conveyer 1 and said entering conveyer 10 or between said insulated conveyer 1 and said delivery conveyer 11 in an electrically insulated state while keeping a required insulation distance between each of them, and a voltage controller 25 disposed for gradually increasing a voltage applied to said relay transfer device 12 forwarding from the side of said entering conveyer 10 or the side of said delivery conveyer 11 toward the side of said insulated conveyer 1 into an identical potential with that of said insulated conveyer 1 and gradually decreasing the voltage applied to said relay transfer device 12 forwarding from the side of said insulated conveyer 1 to the side of said entering conveyer 10 or the side of said delivery conveyer 11 to the grounding potential.

7. An electrostatic coating facility as defined in claim 6, wherein the voltage controller 25 comprises a linear resistor 91 having a high resistance value and a contact member 92 disposed on said resistor 91, with both ends of which being electrically connected to the side of the ground (G) and the high voltage respectively, and the contact member 92 being electrically connected with said relay transfer device 12.

* * * * *